US009368295B2

(12) United States Patent
Feng et al.

(10) Patent No.: US 9,368,295 B2
(45) Date of Patent: Jun. 14, 2016

(54) ELECTRICAL TRANSFER SWITCH SYSTEM

(71) Applicants: Jifeng Feng, Shanghai (CN); Liqiang Wang, Xian (CN)

(72) Inventors: Jifeng Feng, Shanghai (CN); Liqiang Wang, Xian (CN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 14/241,451

(22) PCT Filed: Feb. 27, 2013

(86) PCT No.: PCT/CN2013/071942
§ 371 (c)(1),
(2) Date: Feb. 27, 2014

(87) PCT Pub. No.: WO2014/131163
PCT Pub. Date: Sep. 4, 2014

(65) Prior Publication Data
US 2015/0371792 A1 Dec. 24, 2015

(51) Int. Cl.
*H01H 3/46* (2006.01)
*H01H 9/26* (2006.01)
*H01H 9/36* (2006.01)
(Continued)

(52) U.S. Cl.
CPC . *H01H 3/46* (2013.01); *H01H 9/26* (2013.01); *H01H 9/34* (2013.01); *H01H 9/362* (2013.01); *H01H 1/226* (2013.01); *H01H 2009/365* (2013.01); *H01H 2205/002* (2013.01);
(Continued)

(58) Field of Classification Search
CPC ..... H01H 3/0253; H01H 3/06; H01H 2009/0083; H01H 9/063; H01H 9/26; H01H 9/362; H01H 33/52
USPC ..... 218/156, 69, 82, 7, 154; 335/255; 307/23, 126
See application file for complete search history.

(56) References Cited

U.S. PATENT DOCUMENTS 4,616,198 A * 10/1986 Pardini ..... H01H 71/04 335/16
6,815,624 B2 11/2004 Schultz
(Continued)

FOREIGN PATENT DOCUMENTS

CN 2353027 Y 12/1999
CN 101145468 A 3/2008
(Continued)

OTHER PUBLICATIONS

Machine translation CN102354638.*
(Continued)

*Primary Examiner* — Renee S Luebke
*Assistant Examiner* — William Bolton
(74) *Attorney, Agent, or Firm* — GE Global Patent Operation; Stephen G. Midgley

(57) ABSTRACT

A system including an automatic transfer switch configured to selectively route power from a first power source or a second power source to a load, comprising a switch configured to be moved between a first position and a second position, a first set of electrical contacts configured to route the power from the first power source when the switch is in the first position, a second set of electrical contacts configured to route the power from the second power source when the switch is in the second position, and a first arc chute housing configured to substantially enclose the first set of electrical contacts when the switch is in the first position.

17 Claims, 5 Drawing Sheets

(51) Int. Cl.
*H01H 9/34* (2006.01)
*H01H 1/22* (2006.01)

(52) U.S. Cl.
CPC ..... *H01H2221/01* (2013.01); *H01H 2231/052* (2013.01); *H01H 2300/018* (2013.01)

(56) References Cited

U.S. PATENT DOCUMENTS

| | | | | |
|---|---|---|---|---|
| 6,849,811 | B1 | 2/2005 | Heflin et al. | |
| 8,415,580 | B2 | 4/2013 | Schaltenbrand et al. | |
| 8,502,102 | B2 | 8/2013 | Eriksson et al. | |
| 2011/0198203 | A1* | 8/2011 | Mueller | H01H 9/38 200/238 |
| 2011/0309052 | A1* | 12/2011 | Schaltenbrand | H01H 9/32 218/156 |
| 2013/0015044 | A1* | 1/2013 | Lee | H01H 1/5822 200/175 |

FOREIGN PATENT DOCUMENTS

| | | | | | |
|---|---|---|---|---|---|
| CN | 101350260 | A | | 1/2009 | |
| CN | 201956215 | U | | 8/2011 | |
| CN | 202034296 | U | | 11/2011 | |
| CN | 102354638 | A | * | 2/2012 | H01H 3/00 |
| CN | 102856125 | A | | 1/2013 | |
| CN | 102893360 | A | | 1/2013 | |

OTHER PUBLICATIONS

International Search Report, dated Nov. 28, 2013.
Unofficial English translation of Office Action and Search Report issued in connection with corresponding CN Application No. 201380002848.1 on Dec. 3, 2015.

* cited by examiner

ELECTRICAL TRANSFER SWITCH SYSTEM

BACKGROUND

The subject matter disclosed herein relates to electrical systems, and more specifically, to electrical switches.

Electrical systems may contain various electrical components, such as circuit breakers and transfer switches, which connect a power source to a load. For example, a transfer switch may selectively connect the load to a first power source or a second power source, depending on the availability of an operating condition of each power source. In the case of an automatic transfer switch, the transfer switch may automatically switch from the first power source to the second power source when the first power source becomes unavailable. Switching between power sources may benefit from improved efficiency and other advantages.

BRIEF DESCRIPTION

The described embodiments are intended only to be exemplary and may be similar to or different from the embodiments set forth below.

In one embodiment, a system includes an automatic transfer switch configured to selectively route power from a first power source or a second power source to a load comprising a switch moveable between first and second positions and configured to rotate a shaft, a first stationary electrical contact, and a first contact support assembly. The first contact support assembly includes a first contact support coupled to a first moveable electrical contact, wherein the first moveable electrical contact is configured to couple to the first stationary electrical contact when the switch is in the first position to route power from the first power source to the load, a first pin extending through an aperture of the first contact support, and a first link bar coupled to the shaft and the first pin and configured to enable rotational movement of the first contact support about an axis of rotation parallel to the shaft to selectively couple or decouple the first moveable electrical contact from the first stationary electrical contact.

In a second embodiment, a system includes an automatic transfer switch configured to selectively route power from a first power source or a second power source to a load, comprising a switch configured to be moved between a first position and a second position, a first set of electrical contacts configured to route the power from the first power source when the switch is in the first position, a second set of electrical contacts configured to route the power from the second power source when the switch is in the second position, and a first arc chute housing configured to substantially enclose the first set of electrical contacts when the switch is in the first position.

In a third embodiment, a system includes an automatic transfer switch configured to selectively route power from a first power source or a second power source to a load, comprising a switch configured to rotate a first shaft and a second shaft between respective first and second positions, a first stationary electrical contact and a first moveable electrical contact configured to couple to one another and route the power from the first power source when the first shaft is in the first position, a second stationary electrical contact and a second moveable electrical contact configured to couple to one another and route the power from the second power source when the second shaft is in the second position, and a first contact support assembly. The first contact support assembly includes a first contact support coupled to the first moveable electrical contact a first pin extending through an aperture of the first contact support and a first link bar coupled to the first shaft and the first pin and configured to enable rotational movement of the first contact support about a first axis of rotation parallel to the first shaft to selectively couple or decouple the first moveable electrical contact from the first stationary electrical contact.

BRIEF DESCRIPTION OF THE DRAWINGS

These and other features, aspects, and advantages of the present embodiments will become better understood when the following detailed description is read with reference to the accompanying drawings in which like characters represent like parts throughout the drawings, wherein.

DETAILED DESCRIPTION

In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

The present disclosure is directed towards systems to at least improve the efficiency and operability of electrical transfer switches (e.g., automatic transfer switches (ATS)). For example, when a moveable electrical contact is coupled to a stationary electrical contact, a complete electrical circuit is formed between a power source and a load (e.g., a motor or another user of electricity). The stationary electrical contact is coupled to a base of the ATS, whereas the moveable electrical contact is coupled to a rotating shaft. Rotation of the shaft selectively couples or decouples the moveable electrical contact from the stationary electrical contact, thereby making (e.g., connecting) or breaking (e.g., disconnecting) the electrical circuit between the power source and the load. In certain embodiments described below, the moveable electrical contact may be enclosed or sealed within a housing (e.g., an arc chute housing), in order to improve the arc quenching performance of the ATS. As a result, operation of the ATS may be more efficient and reliable.

Figure 1:
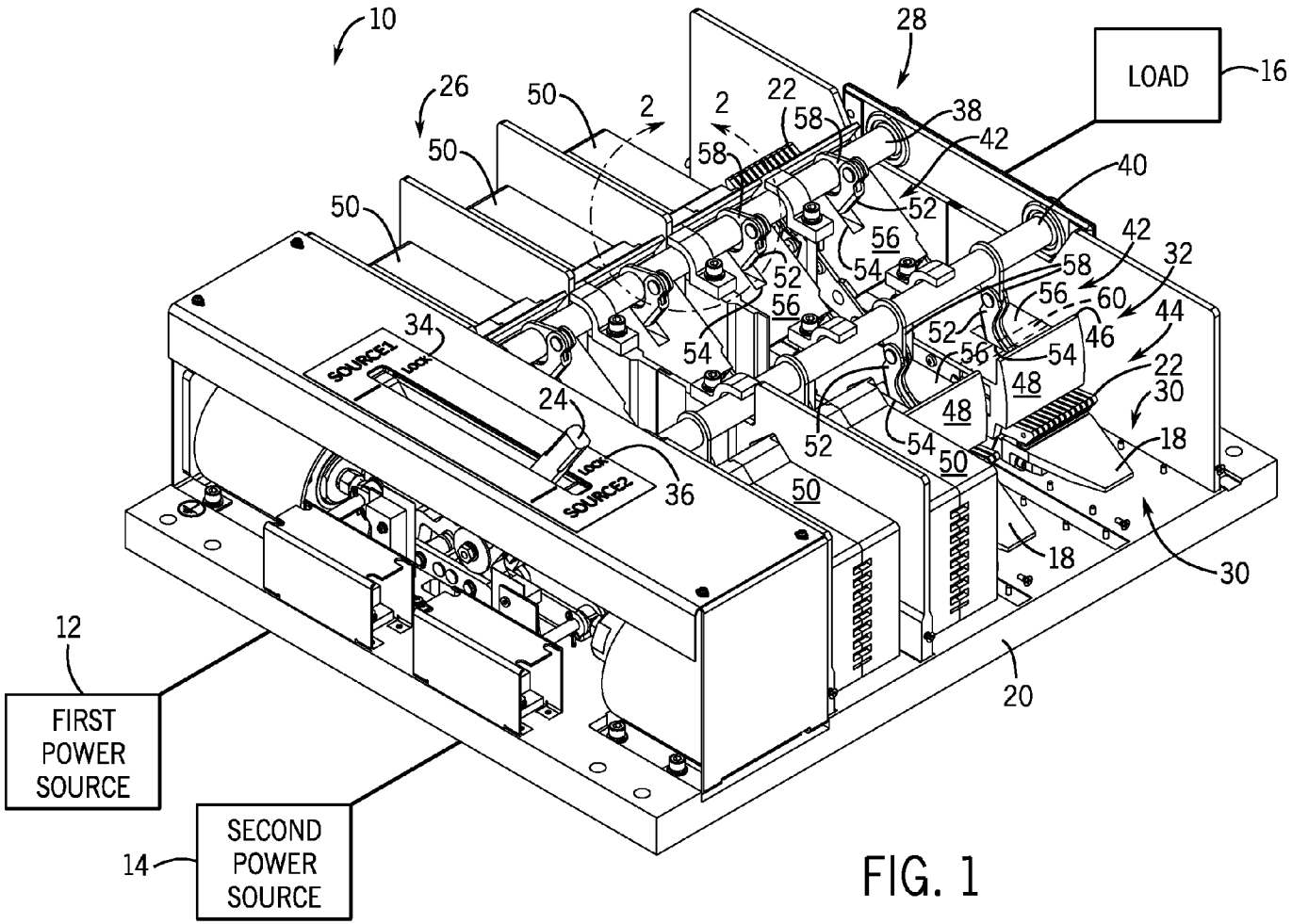
FIG. 1 is a perspective view of an embodiment of an electrical transfer switch configured to route power from a first power source or a second power source toward a load.

Turning now to the figures, FIG. 1 illustrates a perspective view of an embodiment of a transfer switch (e.g., ATS 10) with features to improve the efficiency of making and breaking electrical connections within the ATS 10. The ATS 10 routes power from a first power source 12 or a second power source 14 toward a load 16. For example, the first power source 12 may be a power grid, and the second power source 14 may be a backup electrical generator. The load 16 may be any downstream user of electricity, such as a pump, motor, turbo-machine, refrigeration system, gas turbine system, healthcare system, and/or the like.

The ATS 10 includes one or more stationary electrical contacts 18 (e.g., electrical contact fingers) coupled or fixed to a base 20 of the ATS 10. Each stationary electrical contact 18 has a corresponding moveable electrical contact 22 (e.g., electrical contact fingers). When the moveable electrical contacts 22 and the stationary electrical contacts 18 are coupled together, a complete electrical circuit is formed, thereby enabling power to flow from the first power source 12 or the second power source 14 toward the load 16. For example, as discussed below, the ATS 10 includes a first set of stationary electrical contacts 18 and moveable electrical contacts 22, which, when coupled, route power from the first power source 12 to the load 16. Alternatively, the ATS 10 includes a second set of stationary electrical contacts 18 and moveable electrical contacts 22, which, when coupled, route power from the second power source 12 to the load 16. Furthermore, the ATS 10 is configured such that only one set of stationary and moveable electrical contacts 18 and 22 are coupled at any given time. In this manner, a complete electrical circuit is formed between only one of the first or second power sources 12 and 14 and the load 16. As used herein, the term "moveable" generally means capable of being moved relative to the base 20 of the ATS 10 (e.g., by rotation of a shaft or actuation of a switch), as opposed to fixed in place. That is, the moveable electrical contacts 22 are capable of being moved by actuation of a switch 24, whereas the stationary electrical contacts 18 are generally fixed in place relative to the base 20 of the ATS 10.

A first set of stationary and moveable electrical contacts 26 and 28 are associated with the first power source 12, and a second set of stationary and moveable electrical contacts 30 and 32 are associated with the second power source 14. When the first set of stationary and moveable electrical contacts 26 and 28 are coupled together, the ATS 10 forms a complete electrical circuit between the first power source 12 and the load 16. Likewise, when the second set of stationary and moveable electrical contacts 30 and 32 are coupled together, the ATS forms a complete electrical circuit between the second power source 14 and the load 16. The switch 24 may be moved between first and second positions 34 and 36 in order to respectively couple the first set of contacts 26 and 28 together or the second set of contacts 30 and 32 together. In other words, when the switch 24 is in the first position 34, the first set of contacts 26 and 28 are coupled to one another and the first power source 12 powers the load 16. Additionally, when the switch 24 is in the first position 34, the second set of contacts 30 and 32 are decoupled from one another. Therefore, power transfer from the second power source 14 to the load 16 is blocked. Similarly, when the switch 24 is in the second position 36, the second set of contacts 30 and 32 are coupled to one another and the second power source 12 powers the load 16. Additionally, when the switch 24 is in the second position 36, the first set of contacts 26 and 28 are decoupled from one another. Therefore, power transfer from the first power source 12 to the load 16 is blocked.

As shown, the first set of contacts 26 and 28 includes four stationary electrical contacts 18 and four moveable electrical contacts 22. Similarly, the second set of contacts 30 and 32 includes four stationary electrical contacts 18 and four moveable electrical contacts 22. In certain configurations, the first and second sets of electrical contacts 26, 28, 30, and 32 may contain the same or different numbers of stationary and moveable electrical contacts 18 and 22. Accordingly, the ATS 10 may include any suitable number of stationary or moveable electrical contacts 18 and 22, such as 1, 2, 3, 4, 5, 6, or more.

Figure 2:
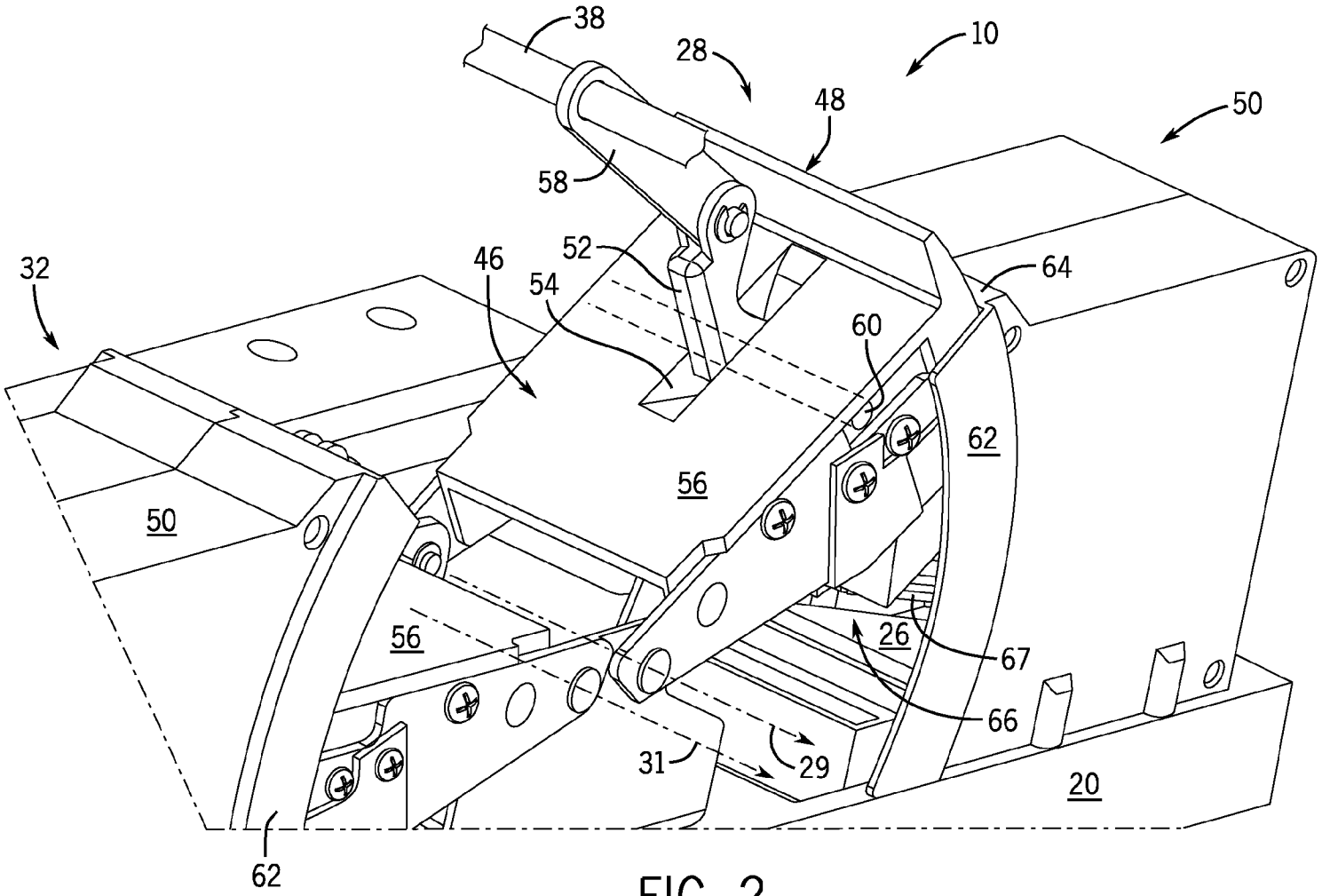
FIG. 2 is a perspective view of an embodiment of a contact support assembly of the electrical transfer switch of FIG. 1, illustrating a contact support configured to abut against an arc chute housing to improve the operability of the electrical transfer switch.

The moveable electrical contacts 22 are coupled to first and second shafts 38 and 40 via contact support assemblies 42. More specifically, the first set of moveable contacts 28 are coupled to the first shaft 38, and the second set of moveable contacts 32 are coupled to the second shaft 40. Actuation or movement of the switch 24 rotates the first and second shafts 38 and 40, thereby adjusting the position of the contact support assemblies 42 and the moveable electrical contacts 22. For example, as best shown in FIG. 2, rotation of the first shaft 38 rotates the first set of moveable electrical contacts 28 about an axis of rotation 29 parallel to the first shaft 38, and rotation of the second shaft 40 rotates the second set of moveable electrical contacts 32 about a second axis of rotation 31 parallel to the second shaft 40. Notably, actuation of the switch 24 rotates both shafts 38 and 40 simultaneously, and, in certain embodiments, in some predetermined ratio relative to one another. For example, the first shaft 38 may rotate at a ratio of approximately 2:1, 1:1, 1:2, or any other suitable ratio, relative to the second shaft 40. As a result of the simultaneous movement, when the first set of stationary and moveable electrical contacts 26 and 28 are coupled together, the second set of stationary and moveable electrical contacts 30 and 32 are decoupled, and vice versa, as described above. This enables only one of the first and second power sources 12 or 14 to be electrically coupled to the load 16 at any given time. However, it should be noted that in certain configurations, it may be desirable for both of the power sources 12 and 14 to be in electrical connection with the load 16 for a brief time (e.g., a closed transition transfer switch or a make before break transfer switch). Furthermore, in certain embodiments, the ATS 10 may include a varying number of shafts 38 and 40 (e.g., 1, 2, 3, 4, 5, 6, or more shafts) to rotate the moveable electrical contacts 22.

The structure of the contact support assembly 42 is described in greater detail below. Referring to FIGS. 1 and 2, the moveable electrical contacts 22 are coupled to a bottom portion 44 of a support structure (e.g., contact support 46). The contact support 46 includes a slot (e.g., rectangular slot) 54 on a top surface 56 of the contact support 46. A link bar 52 is disposed within each of the slots 54 and is configured to mechanically link one of the shafts 38 and 40 to each of the moveable electrical contacts 22. More specifically, the link bar 52 is coupled to one of the shafts 38 or 40 via a linking arm 58 and is coupled to the contact support 46 via a pin 60 (e.g., mounting pin) disposed at least partially within the slot 54. The linking arm 58 and the pin 60 translate rotational movement of the shafts 38 and 40 into rotational movement of the contact support 46 and the moveable electrical contacts 22.

Above the moveable electrical contacts 22 is an arcuate surface 48 (e.g., convex side surface, or outermost side surface). The arcuate surface 48 is configured to abut against a housing 50 (e.g., an arc chute housing) in order to enclose the moveable electrical contacts 22 within the housing 50 during operation of the ATS 10. Each moveable electrical contact 22 has a corresponding arc chute housing 50, although, in the illustrated embodiment, some arc chute housings 50 have been removed to better illustrate the contact support assemblies 42 and the stationary and electrical contacts 18 and 22.

As will be appreciated, enclosing one or more of the moveable electrical contacts 22 increases the air pressure within the arc chute housing 50, thereby reducing the possibility of electrical arcing when the stationary and moveable electrical contacts 18 and 22 engage or disengage with one another. For example, as the current between the electrical contacts 18 and 22 is broken when the electrical contacts 18 and 22 disengage with one another, gas (e.g., electrical arcing gas) within the arc chute housing 50 may expand. As the arc chute housing 50 is at least partially sealed, the arc chute housing 50 may at least partially contain the expanding gases, thereby increasing pressure within the arc chute housing 50 and reducing and/or extinguishing electrical arcing. However, in certain configurations, due to spatial or other considerations, a portion of the moveable electrical contacts 22 may not be enclosed by the arc chute housing 50. The geometries of the contact support 46 and the arc chute housing 50 are illustrated more clearly in FIG. 2.

FIG. 2 is a perspective view of an embodiment of the contact support 46 for one of the first set of moveable electrical contacts 28 and the arc chute housing 50 for one of the first set of stationary electrical contacts 26, taken about lines 2-2 of FIG. 1. As noted above, the contact support 46 and the arc chute housing 50 are configured to continuously abut each other during operation of the ATS 10, thereby enclosing one of the moveable electrical contacts 22 and reducing the possibility of electrical arcing between the moveable electrical contact 22 and the stationary electrical contact 18. More specifically, wide arms 62 (e.g., arcuate wide or side arms) and an outer surface (e.g., concave housing exterior surface) 64 of the arc chute housing 50 are shaped to receive and continuously contact the arcuate surface 48 of the contact support 46 as the contact support 46 rotates about the axis of rotation 29. That is, the shape of the housing exterior surface 64 is the shape traced by rotation of the arcuate surface 48 of the contact support 46 about the axis of rotation 29. Accordingly, the shape of the housing exterior surface 64 is generally arcuate and may be, for example, circular, elliptical, parabolic, and/or the like. As shown, the wide arms 62 of the arc chute housing 50 extend partially along sides of the contact support 46. In this manner, the contact support 46 and the arc chute housing 50 may create a substantially sealed volume when the stationary and moveable electrical contacts 18 and 22 are electrically coupled to one another.

As shown in the illustrated embodiment, the first set of stationary and moveable electrical contacts 26 and 28 are disengaged and separated from one another. This separation defines a gap 66 between the base 20 of the ATS 10 and the contact support 46 of the moveable electrical contact 28. In other words, the moveable electrical contacts 22 are not entirely enclosed by the arc chute housing 50 when the first set of stationary and moveable electrical contacts 26 and 28 are decoupled from one another. Furthermore, in the illustrated embodiment, the second set of stationary and moveable electrical contacts 30 and 32 are coupled together. As a result, there is no gap 66 between the base 20 and the contact support 46 for the moveable electrical contact 32. As such, the moveable electrical contacts 32 are substantially sealed within the arc chute housing 50, thereby decreasing the possibility of electrical arcing and confining electrical arcs within the housing 50. In certain embodiments, the arc chute housing 50 may also include a plurality of stationary interior blades 67 that further reduce the possibility of electrical arcing. As will be appreciated, when the moveable electrical contacts 32 are enclosed within the arc chute housing 50, the top surface 56 of the contact support 46 may be generally parallel with the base 20. Features of the contact support 46 are discussed in greater detail with respect to FIG. 3.

Figure 3:
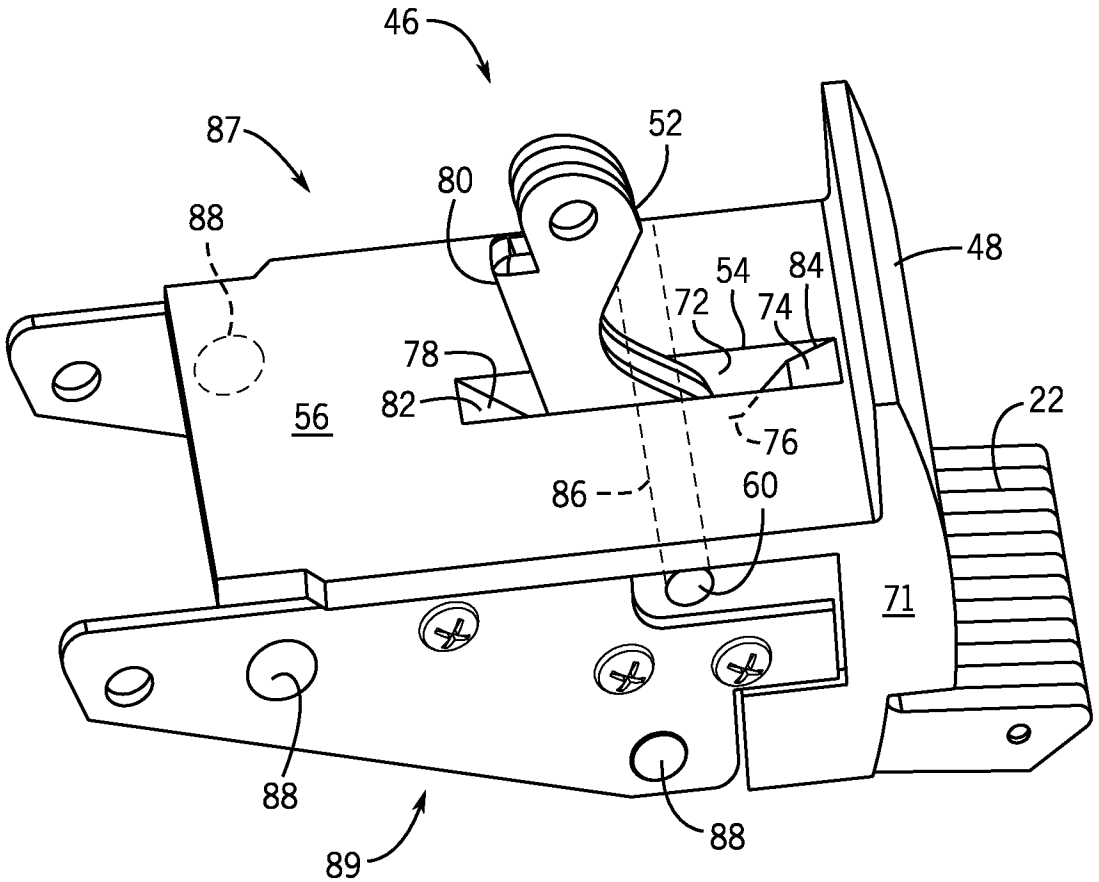
FIG. 3 is a perspective view of an embodiment of the contact support of FIG. 2, illustrating multiple features to improve the operability of the electrical transfer switch.

FIG. 3 is a perspective view of an embodiment of the contact support 46 of FIG. 2. As explained earlier, the arcuate surface 48 of the contact support 46 is configured to abut against the outer surface 64 (e.g., concave outer surface) of the arc chute housing 50. Similarly, side walls 71 of the contact support 46 are configured to abut against the wide arms 62 of the arc chute housing 50, thereby constraining movement of the moveable electric contacts 22. Additionally, the side walls 71 of the contact support 46 and the wide arms 62 may further function to substantially seal a volume within the arc chute housing 50 when the moveable electrical contacts 20 and the stationary electrical contacts 18 are coupled to one another.

As mentioned above, the contact support 46 includes the slot 54 configured to receive the link bar 52. The slot defines four interior walls 72, 74, 76, and 78. The walls 72 and 76 are opposite from one another. As shown, the link bar 52 has a generally U-shape 80 that is configured to contact both of the opposite interior walls 72 and 76 (e.g., interior axial walls). In a similar manner, the walls 74 and 78 define respective slanted portions 82 and 84 that also abut against the U-shape 80. Thus, the walls 72, 74, 76, and 78 hold the U-shape 80 in place and reduce the possibility of relative movement between the link bar 52 and the contact support 46. In other embodiments, the shape of the link bar 52 may vary. For example, the link bar 52 may be rectangular, arcuate, U-shaped, polygonal, or have any other suitable shape configured to abut the walls 72, 74, 76 and 78.

The contact support 46 may also include a plurality of pads 88 (e.g., rounded or circular pads) that provide spacing between adjacent contact supports 46 or other components of the ATS 10. In certain embodiments, the round pads 88 may include non-conductive materials, such as felt or rubber. The pads 88 are disposed on opposite sides 87 and 89 of the contact support 46. In certain embodiments, the number of pads 88 on each contact support 46 may vary. For example, the contact support 46 may include 1, 2, 3, 4, 5, 6, or more pads 88. It should be noted, however, that certain embodiments may not include any pads 88.

An aperture 86 extends through the contact support 46 and crosswise (e.g., perpendicularly) to the slot 54. In operation, the pin 60 is disposed within the aperture 86, and the link bar 52 is coupled to the pin 60. In the manner described below, the link bar 52 and the pin 60 may be coupled to one another to allow rotation of the contact support 46 (e.g., about the axis 29), while also blocking translation of the pin 60 within the aperture 86. In other words, the link bar 52 and the pin 60 may be configured to mate to one another to restrict axial movement of the pin 60, as it may be desirable to reduce relative movement between the pin 60 and the link bar 52 during operation of the ATS 10. As discussed below with respect to FIG. 4, the pin 60 may include a groove or other features to axially constrain the link bar 52, thereby improving the operability of the ATS 10. As will be appreciated, the pin 60 and the aperture 86 may generally have a similar shape. As illustrated, the aperture 86 and the pin 60 are both cylindrical, but may have any other suitable shape (e.g., square, polygonal, etc.).

Figure 5:
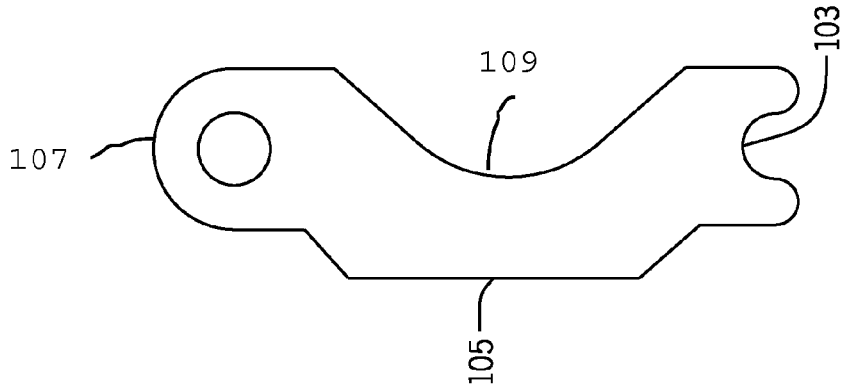
FIG. 5 is a side view of another embodiment of a link bar insert.
Figure 4:
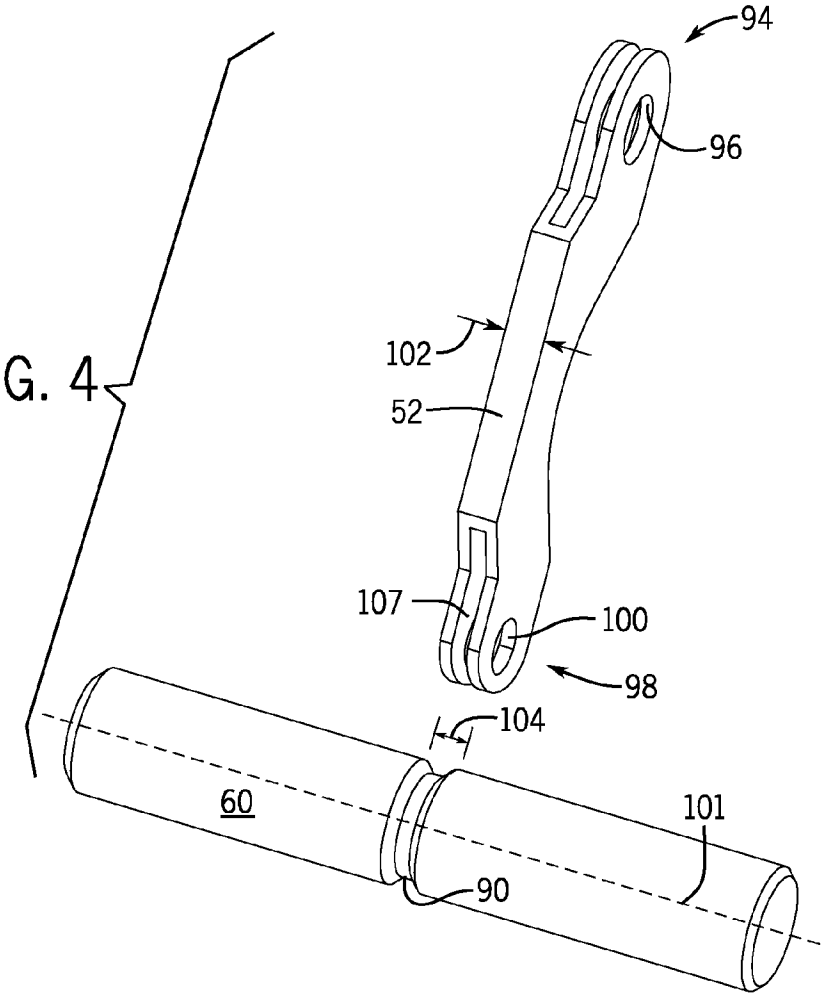
FIG. 4 is a perspective view of an embodiment of a mounting pin and a link bar of the contact support assembly of FIG. 2.

FIG. 4 is a perspective view of an embodiment of the link bar 52 and the pin 60. Additionally, FIG. 5 illustrates a side view of a link bar insert 105, which is positioned within the link bar 52. As shown in FIGS. 4 and 5, the link bar 52 and the link bar insert 105 have similar side profiles and/or shapes. As further shown in FIG. 4, the pin 60 includes a groove 90 (e.g., a circumferential or annular groove) disposed approximately at the axial center of the pin 60. In other embodiments, the groove 90 is located in other locations. For example, the contact supports 46 share a common pin 60, and the grooves 90 are equally or nearly equally spaced along a length of the pin 60. In other words, each contact support 46 may have a separate pin 60, or the pin 60 may be shared among one or more contact supports 46.

In FIGS. 4 and 5, the top 107 end 94 of the link bars 52 are rounded to more easily mate to a linking arm 58 as shown in FIG. 2; also, the rounded shape reduces the possibility of electromagnetic interference or creating antenna-like effects. In other embodiments, the top 107 has a flat or square shape to simplify manufacturing. There is also a curvature 109 that allows the link bar 52 to mate or to have a sliding contact with the rounded surface of pin 60. Otherwise, curvature 109 allows the link bar 52 to more easily clear the relative motion between the link bar 52 and the arcuate surface 48 when space becomes limited. There is also a notch (part of U-shape 80) on either end of the link bar insert 105, where the notch helps to engage and maintain contact. In one embodiment, the link bars 52 are made of electrically conductive metallic material such as aluminum, copper, magnesium, tungsten, or steel. In an embodiment, the material is non-magnetic or non-ferrous such as aluminum or copper. As different forms of plastic, fiber-reinforced or other synthetic material become stronger and heat resistant, such material can also be used to fabricate the link bars 52.

As shown in the illustrated embodiment, a first end 94 of the link bar 52 has an aperture 96 (e.g., circular orifice) configured to receive the linking arm 58 shown in FIGS. 1 and 2. In certain embodiments, the linking arm 58 is not fixed within the aperture 96 relative to the link bar 52. In this manner, the link bar 52 may rotate relative to the linking arm 58 as the linking arm is 58 is rotated. Similarly, a second end 98 of the link bar 52 has an aperture 100 (e.g., circular orifice) configured to receive the pin 60. That is, the pin 60 extends through the aperture 100 in the second end 98. In order to further reduce the possibility of relative movement between the pin 60 and the link bar 52, the link bar insert 105 shown in FIG. 5 may be inserted into a central space 107 formed by the link bar 52. More specifically, when the link bar 52 is coupled to the pin 60 and the link bar insert 105 is inserted into the link bar 52, an abutting portion 103 (e.g., semi-circular U-shaped abutting portion) of the link bar insert 105 may engage with the groove 90 of the pin 60. In this manner, the pin 60 may be blocked from moving or sliding out of the aperture 86 of the contact support 46.

Figure 6:
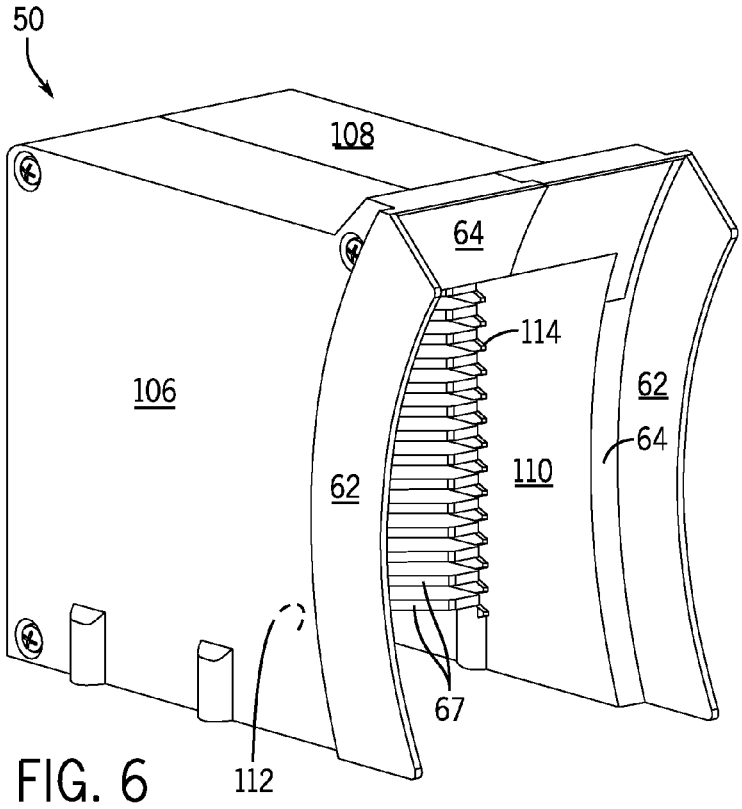
FIG. 6 is a perspective view of an embodiment of the arc chute housing of FIG. 2, illustrating a plurality of blades to improve arc quenching of the electrical transfer switch.
Figure 7:
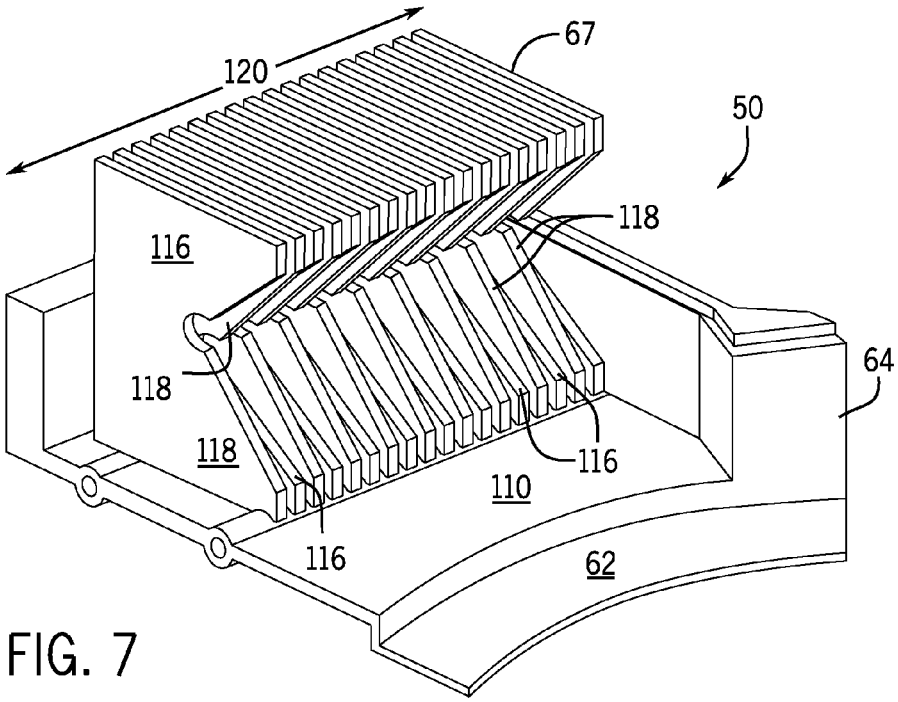
FIG. 7 is a perspective view of an embodiment of the arc chute housing blades of FIG. 5.

FIGS. 6 and 7 are perspective views of embodiments of the arc chute housing 50, illustrating the wide arms 62 and exterior surface 64 configured to abut the contact support 46 (e.g., the arcuate surface 48 of the contact support 46). In the embodiment illustrated, the arc chute housing 50 is assembled from two portions 106 and 108 (e.g., two halves). However, in certain configurations, the arc chute housing 50 is integrally formed as a one-piece structure. The two portions 106 and 108 define opposite interior walls 110 and 112. The arc chute housing 50 further includes blade mounting portions 114 (e.g., blade mounting rails) that extend along the opposite interior walls 110 and 112. As shown, the blade mounting portions 114 are configured to receive the blades 67. As shown in FIG. 7, the blades 67 may be generally M-shaped and may help to contain and/or extinguish electrical arcs that may form during operation of the ATS 10. For example, the blades 67 may decrease the resistance of electrical arcing gas within the arc chute housing 50 such that the gas may move within the blades more easily. In the illustrated embodiment, the blades 67 are asymmetric and include a smaller triangular portion 116 and a larger triangular portion 118. The smaller portions 116 are placed alternatingly with the larger portions 118 along a height 120 of the arc chute housing 50, thereby increasing the surface area available to quench electrical arcs that may form during operation of the ATS 10.

Technical effects of the disclosed embodiments include systems to improve the efficiency and operability of the ATS 10. The stationary electrical contacts 18 are coupled to the base 20 of the ATS 10, while the moveable electrical contacts 22 are coupled to the respective shafts 38 or 40. Rotation of the shafts 38 or 40 selectively couples or decouples the moveable electrical contact 22 from the stationary electrical contact 18, thereby making or breaking the electrical circuit between the power sources 12 or 14 and the load 16. Advantageously, the moveable electrical contacts 22 may be enclosed or sealed within the arc chute housing 50, in order to reduce the possibility of electrical arcing within the ATS 10. For example, contact supports 46 that support the moveable electrical contacts 22 may have the arcuate surface 48 that substantially mates with the outer surface 64 and the wide arms 62 of the arc chute housing 50. In this manner, a substantially sealed volume within the arc chute housing 50 may be maintained, and air pressure within the arc chute housing 50 may be increased, thereby improving the extinguishing of arcs forming during coupling and decoupling of the stationary and moveable electrical contacts 18 and 22 of the ATS 10. For example, as the current between the electrical contacts 18 and 22 is broken when the electrical contacts 18 and 22 disengage with one another, gas (e.g., electrical arcing gas) within the arc chute housing 50 may expand. As the arc chute housing 50 is at least partially sealed, the arc chute housing 50 may at least partially contain the expanding gases, thereby increasing pressure within the arc chute housing 50 and reducing and/or extinguishing electrical arcing.

This written description uses examples to disclose the various embodiments, including the best mode, and also to enable any person skilled in the art to practice the embodiments, including making and using any devices or systems and performing any incorporated methods. The patentable scope of the embodiments is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

In addition, words such as "top," "bottom," "on top of," etc. are not absolute orientations because objects can be rotated, turned on their sides and so on. Then "top" may become the "bottom" or vice versa relative to a viewer.

What is claimed is:

1. A system, comprising:

an automatic transfer switch configured to selectively route power from a first power source or a second power source to a load, comprising:

a switch moveable between first and second positions and configured to rotate a shaft;

a first stationary electrical contact; and a first contact support assembly, comprising:

a first contact support coupled to a first moveable electrical contact, wherein the first moveable electrical contact is configured to couple to the first stationary electrical contact when the switch is in the first position to route power from the first power source to the load;

a first pin extending through an aperture of the first contact support; and a first link bar coupled to the shaft and the first pin and configured to enable rotational movement of the first contact support about an axis of rotation parallel to the shaft to selectively couple or decouple the first moveable electrical contact from the first stationary electrical contact;

wherein the first pin comprises a groove configured to engage with a first link bar insert of the first link bar and to limit axial movement of the in within the first contact support.

2. The system of claim 1, wherein the first link bar is disposed within a slot formed on a top surface of the first contact support and extending through the orifice of the first contact support.

3. The system of claim 1, wherein the link bar insert comprises a U-shape.

4. The system of claim 1, comprising a first arc chute housing configured to substantially enclose the first moveable electrical contact and the first stationary electrical contact when the switch is in the first position.

5. The system of claim 4, wherein the first arc chute housing, comprises a housing exterior surface configured to continuously abut an outermost exterior surface of the first contact support during rotational movement of the first contact support about the axis of rotation.

6. The system of claim 5, wherein the housing exterior surface and the outermost exterior surface of the first contact support are arcuate.

7. The system of claim 6, wherein the housing exterior surface is concave and the outermost exterior surface is convex.

8. The system of claim 4, wherein the first arc chute housing comprises a plurality of blades extending between first and second interior walls of the first arc chute housing.

9. A system comprising:

an automatic transfer switch configured to selectively route power from a. first power source or a second power source to a load, comprising:

a switch configured to be moved between a first position and a second position;

a first set of electrical contacts configured to route the power from the first power source when the switch is in the first position;

a second set of electrical contacts configured to route the power from the second power source when the switch is in the second position; and a first arc chute housing configured to substantially enclose the first set of electrical contacts when the switch is in the first position wherein the switch is configured to rotate a shaft, and wherein the automatic transfer switch comprises:

a first contact support assembly, comprising:

a first contact support. coupled to a first moveable electrical contact of the first set of electrical contacts, wherein the first moveable electrical contact is configured to couple to a first stationary electrical contact of the first set of electrical contacts when the switch is in the first position;

a first pin extending through an aperture of the first contact sun)ort wherein the first pin comprises a groove configured to engage with a first link bar insert of the first link bar and to limit axial movement of the pin within the first contact support; and a first link bar coupled to the shaft and the first pin and configured to enable rotational movement of the first contact support about an axis of rotation parallel to the Shaft to selectively couple or decouple the first moveable electrical contact from the first stationary electrical contact.

10. The system of claim 9, wherein the first arc chute housing comprises a plurality of blades extending between first and second interior walls of the first arc chute housing.

11. The system of claim 10. wherein the plurality of blades comprises at least two blades with different orientations.

12. The system of claim 9, wherein the first arc chute housing comprises a housing exterior surface configured to continuously abut to an outermost exterior surface of the first contact support during rotational movement of the first contact support about the axis of rotation.

13. The system of claim 12, wherein the housing exterior surface is concave and the contact exterior surface is convex.

14. The system of claim 9, wherein the housing exterior surface comprises at least one wide arm configured to continuously abut a side wall of the contact exterior surface during rotational movement of the first contact support about the axis of rotation.

15. A system, comprising:

an automatic transfer switch configured to selectively route power from a first power source or a second power source to a load, comprising:

a switch configured to rotate a first shaft and a second shaft between respective first and second positions;

a first stationary electrical contact and a first moveable electrical contact configured to couple to one another and route the power from the first power source when the first shaft is in the first position;

a second stationary electrical contact and a second moveable electrical contact configured to couple to one another and route the power from the second power source when the second shaft is in the second position;

a first contact support assembly, comprising:

a first contact support coupled to the first moveable electrical contact;

a first pin extending through an aperture of the first contact support; and a first link bar coupled to the first shaft and the first pin and configured to enable rotational movement of the first contact support about a first axis of rotation parallel to the first shaft to selectively couple or decouple the first moveable electrical contact from the first stationary electrical contact; and a first arc chute housing configured to substantially enclose the first electrical moveable contact and the first stationary electrical contact when the first shaft is in the first position;

wherein the first pin comprises a groove configured to receive a first link bar insert of the first link bar and to limit axial movement of the in within the a)erture of the first contact support.

16. The system of claim 15, wherein the first arc chute housing comprises a plurality of blades extending between first and second interior walls of the first arc chute housing.

17. The system of claim 15, wherein the first arc chute housing comprises a housing exterior surface configured to continuously abut an outermost exterior surface of the first contact support during rotational movement of the first contact support about the first axis of rotation.

* * * * *